United States Patent [19]

Hounsel et al.

[11] 4,429,504

[45] Feb. 7, 1984

[54] FIBER BLANKET INSULATION MODULE

[75] Inventors: Mack A. Hounsel; Carlisle O. Byrd, Jr., both of Houston, Tex.

[73] Assignee: Manville Service Corporation, Denver, Colo.

[21] Appl. No.: 309,594

[22] Filed: Oct. 8, 1981

Related U.S. Application Data

[63] Continuation-in-part of Ser. No. 245,946, Mar. 20, 1981, Pat. No. 4,381,634.

[51] Int. Cl.[3] ..... E04B 1/80

[52] U.S. Cl. ..... 52/506; 52/404; 52/509

[58] Field of Search ..... 52/506, 509, 513, 404, 52/511; 110/331, 336, 338; 428/245

[56] References Cited

U.S. PATENT DOCUMENTS

| | | | |
|---|---|---|---|
| 3,077,058 | 2/1963 | Hensel | 52/410 X |
| 3,400,672 | 9/1968 | Dickson | 52/506 X |
| 3,819,468 | 6/1974 | Sauder et al. . | |
| 3,832,815 | 9/1974 | Balaz et al. . | |
| 3,854,262 | 12/1974 | Brady | 52/404 |
| 3,892,396 | 7/1975 | Monaghan . | |
| 3,952,470 | 4/1976 | Byrd, Jr. . | |
| 4,001,996 | 1/1977 | Byrd, Jr. . | |
| 4,012,877 | 3/1977 | Byrd | 52/511 X |
| 4,055,926 | 11/1977 | Byrd, Jr. . | |
| 4,086,737 | 5/1978 | Byrd, Jr. . | |
| 4,103,469 | 8/1978 | Byrd, Jr. . | |
| 4,123,886 | 11/1978 | Byrd, Jr. . | |
| 4,218,962 | 8/1980 | Cunningham et al. | 52/509 |
| 4,287,839 | 9/1981 | Severin et al. | 110/331 |
| 4,339,902 | 7/1982 | Cimochowski et al. | 52/404 X |
| 4,381,634 | 5/1983 | Hounsel et al. | 52/509 X |

OTHER PUBLICATIONS

T. E. Smith, CER-Wool "Nip & Tuck" Modular System, 9/20/79, whole article.

T. E. Smith, "Nip and Tuck" Modules, 8/29/80, whole article.

*Primary Examiner*—J. Karl Bell

*Attorney, Agent, or Firm*—R. M. Halvorsen; R. K. Thomson

[57] ABSTRACT

Refractory ceramic fiber blanket modules with a continuous strip of ceramic fiber material folded, such as into a number of layers in a serpentine fashion, are used to insulate high temperature equipment. The blanket is supported by support structure which penetrates the blanket in the vicinity of folds near the furnace wall, providing increased strength against tearing away of the blanket from the supports. The attachment structure of the module permits the module to be installed on non-planar or curved surfaces as well as planar or flat surfaces.

15 Claims, 7 Drawing Figures

Fig. 4A
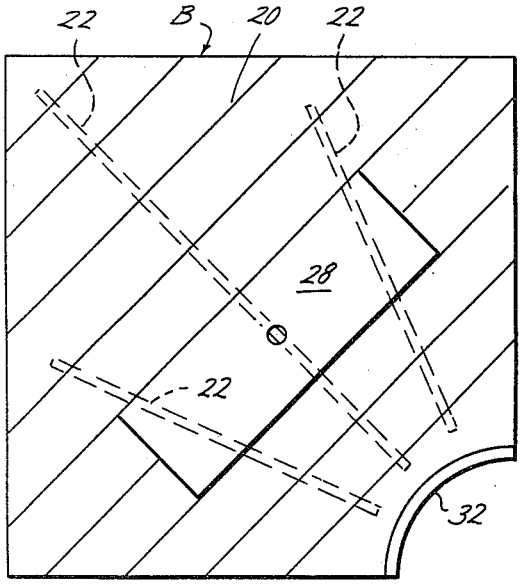
Fig. 4B
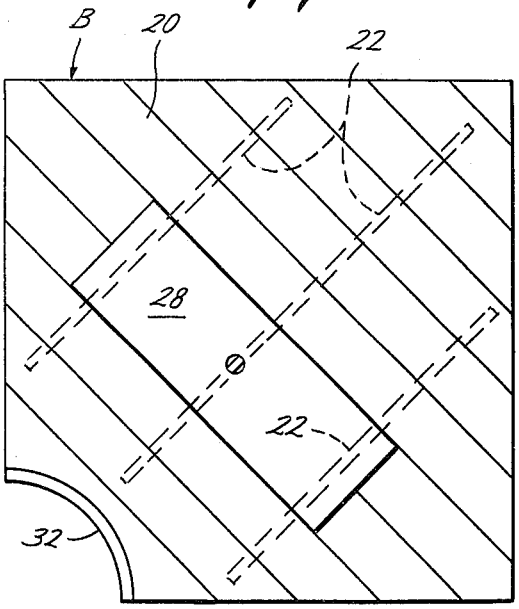
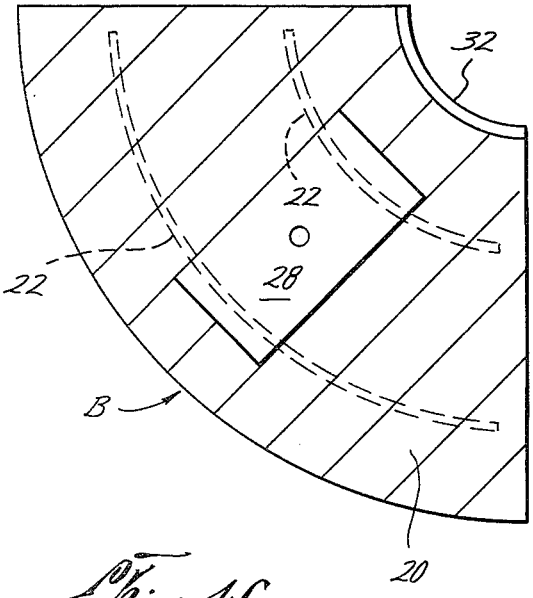
Fig. 4C
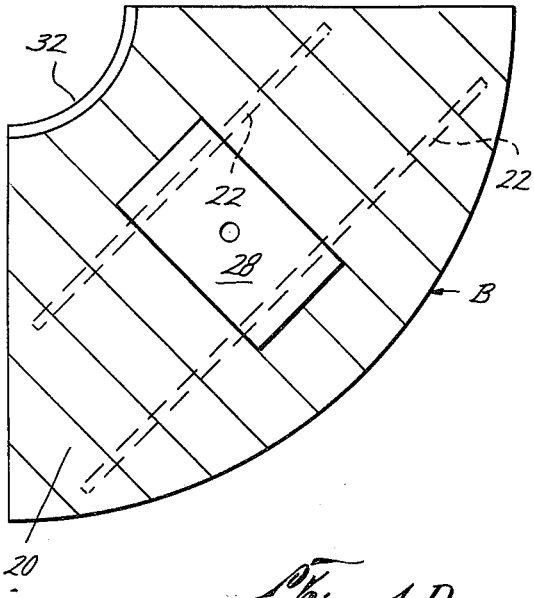
Fig. 4D

FIBER BLANKET INSULATION MODULE

CROSS-REFERENCE TO RELATED APPLICATIONS

The present application is a continuation-in-part of our prior U.S. Patent Application Ser. No. 245,946, filed Mar. 20, 1981 and co-pending herewith now U.S. Pat. No. 4,381,634.

FIELD OF INVENTION

The present invention relates to modular refractory ceramic fiber blanket insulation systems.

DESCRIPTION OF PRIOR ART

U.S. Pat. Nos. 3,952,470 and 4,001,996 each relate to modular refractory ceramic fiber blocks formed from folded ceramic fiber blankets for insulating furnaces and the like. In these modules, supporting rods were mounted within and extended along certain of the folds in the blankets. In the foregoing U.S. Patents, the modules were attached to the furnace wall by a channel member which extended transversely across the rear face of the insulation block in a direction transverse to the direction of the folds of the blanket of the block. This caused a problem when insulating modules were required for curved or non-planar surfaces, since the channel members were relatively inflexible. Other U.S. Patents relating to insulation modules of which one of applicants is inventor are U.S. Pat. Nos. 4,055,926; 4,086,737; 4,103,469; and 4,123,886. These modules used channel attachment structure, as well.

Another type of modules, such as in U.S. Pat. Nos. 3,819,468 and 3,832,815 has utilized wires or pins extending transversely through a number of aligned strips of "edge grain" ceramic fiber material or blanket to hold the strips together in the module. In U.S. Pat. No. 3,819,468, uncompressed strips of the blanket were mechanically attached to a board of material such as vermiculite which was then mechanically attached to the furnace shell. In U.S. Pat. No. 3,832,815 compressed strips of blanket were restrained on an inner surface or cold face by internal rods which attach to an expanded metal angle member at the sides were attached to the furnace wall.

Another type of furnace insulation, although not generally considered to be modules, impaled the insulative blanket onto spears or hangers generally parallel to the furnace walls. These spears were separate hardware items which had to be installed on the furnace wall in the field while the blanket was being attached, causing a more complicated installation, and also causing this type of insulation to not be regarded as modules. Examples of this type of insulation are U.S. Pat. No. 3,892,396 and the type sold as "Nip & Tuck" insulation by C-E Refractories, Combustion Engineering, Inc. of Valley Forge, Pennsylvania. Also, in the "Nip & Tuck" type, the attachment structure used was such that insulation could not be removed independently of each other.

SUMMARY OF INVENTION

Briefly, the present invention comprises a new and improved ceramic fiber blanket module for insulating an inner surface, such as a wall or roof or the like, in a furnace or other type of heating or heat-treating equipment. The module is formed from plural folds of adjacent layers of refractory ceramic fiber insulating material which are supported on the inner wall of the furnace.

The folded insulating blanket is preferably formed from a continuous strip of ceramic fiber material folded into a number of layers in a serpentine or undulating form. The folded blanket has an inner surface portion to be exposed along an insulation surface to interior conditions in the furnace and an outer surface portion adapted to be mounted against a wall of the furnace. Side portions of adjacent layers extend generally perpendicularly to the furnace wall and parallel to each other and are folded into U-shaped folds at inner and outer ends adjacent the inner and outer surfaces to form alternating inner and outer folds.

The folded insulating blanket is supported on the furnace inner surface by supports which extend through plural side portions of the blanket adjacent the outer folds. A suspension channel member is mounted on the outer surface of the blanket adjacent layers to receive the supports. The suspension channel member is mounted to extend in the direction of the folds in the blanket and may cover less than one of the surface dimensions of the block. The suspension channel member is attached by attachment structure to the inner surface of the furnace. With the supports extending through the side portions of blanket and mounted adjacent the outer folds, improved strength and resistance to tearing or pull-away of the blanket from the supports has been found to be achieved with the present invention. Further, with the suspension channel member of the present invention, the supports in the block may be bent so that the surfaces of the block conform to curved surfaces. Thus, modules of the present invention may be installed on curved surfaces in high temperature equipment, as well as on flat or planar surfaces.

BRIEF DESCRIPTION OF THE DRAWINGS

FIGS. 4A, 4B, 4C and 4D are plan views of other insulation modules of the present invention.

DESCRIPTION OF THE PREFERRED EMBODIMENTS

Figure 1:
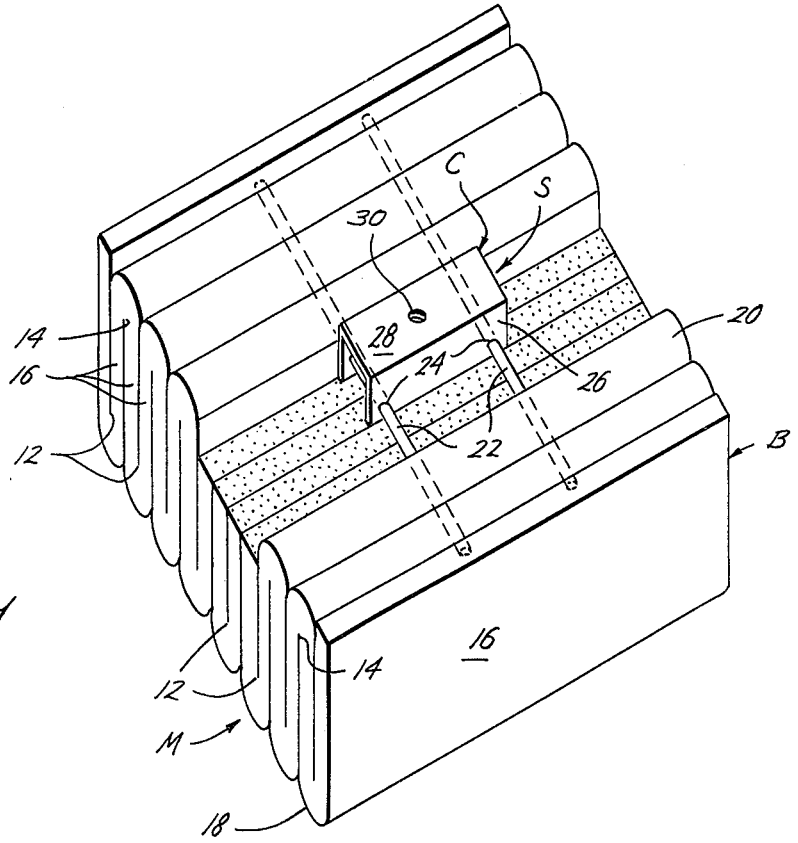
FIG. 1 is an isometric view, taken partly in cross-section, of an insulation module according to the present invention.

In the drawings, the letter M (FIG. 1) designates generally a refractory ceramic fiber blanket module or block for mounting with an inner surface, such as a wall or roof, of a furnace or other heating, heat treating or high temperature equipment. For this reason, furnace and high temperature equipment will be used interchangeably in this description. The module M is preformed from a folded insulating blanket B and is supported on the inner surface by support structure S.

Figure 2:
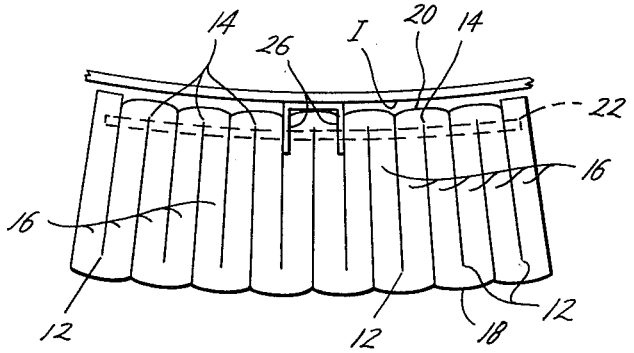
FIGS. 2 and 3 are elevation views of the module of FIG. 1 conforming to curved surfaces.
Figure 3:
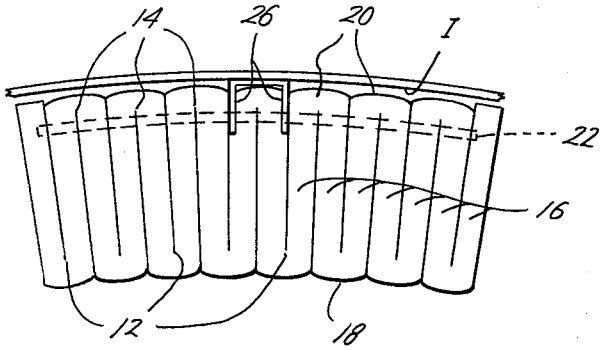

The blanket B may be any of several commercially available high temperature refractory ceramic fiber blanket materials, such as those containing aluminum-silica fibers as disclosed in U.S. Pat. Nos. 3,952,470 and 4,001,996. The blanket B is preferably in the form of a continuous strip 10 of the ceramic fiber blanket material folded into alternate U-shaped inner folds 12 and outer folds 14 interconnected with each other by parallel side portions 16. The side portion 16 extend between an inner surface 18 adjacent the inner folds 12 and an outer surface 20 adjacent the outer folds 14. The inner surface 18, commonly referred to in the art as a "hot face", is exposed to internal conditions in the high temperature equipment being insulated, while the outer surface 20 is adapted to be mounted against an inner surface I (FIGS. 2 and 3) of the equipment by the support S. It should also be understood that the blanket B may be folded in the manner of U.S. Pat. No. 3,952,470, if desired, having no inner folds.

In the support S (FIGS. 1 and 2), a support means 22 in the form of plurality of rods or bars or tubes extends through a plurality of side portions 16 of the blanket B adjacent the outer folds 14 to support the blanket in place when the module M is installed. Although two rods 22 are shown in the drawing, greater numbers, or a single support rod, may be used if desired. The blanket B, on installation, is normally in a state of compression, and thus because of this and the frictional engagement between the fibers adjacent layers of the folded blanket, the rods 22 need not extend completely through the entire blanket B. It should be understood that the rods 22 may, however, extend completely through the blanket B, if desired. Rods 22 are shown in the preferred embodiment as a solid rod of suitable material, such as stainless steel of suitable temperature characteristics based on temperature conditions in the equipment. It should be understood, however, that other shaped members may serve as a support means. For example, a hollow tubular member, a bar or rod of generally rectangular cross-section or other suitable shape of elongate member may be used as a support means with the present invention.

The support rods 22 are mounted at spaced positions from each other, preferably at a common distance from the outer surface portion 20 of the blanket B. Each of the support rods 22 is received in a suitable opening 24 in a suspension arm 26 of a channel member C of the present invention. A suspension channel member C of the present invention receives the support rods 22 therein in openings 24 formed in each of a pair of suspension tabs 26. The suspension tabs 26 of the channel member C are interconnected by wall plate member 28, which has an opening 30 formed therein to permit channel member C, and thus the module M, to be attached to the wall being insulated. It should be understood that the channel member C may be attached to the wall by any suitable attaching structure, such as those of U.S. Pat. Nos. 3,952,470 and 4,001,996.

It is to be noted that the suspension channel member C of the present invention is mounted extending parallel with the direction of the folds 12 and 14 of the blanket B. Further, the channel member C may cover less than a complete surface dimension of either dimension of the surface 20 of the blanket B. The suspension tabs 26 are thus inserted in blanket layers located adjacent two outer folds 14 until the wall plate member 28 rests on the outer surface 20 of the folded blanket B. Usually, the plate member 28 is of a width in the direction of the rods 22 to encompass at least two adjacent outer folds 14 within the channel member C, although other numbers of folds may also be encompassed. It should also be understood that, if desired, the suspension tabs 26 may be inserted through small slits formed directly in the blanket B, rather than in the folds 14 or 16, if desired, so long as the openings 24 of tabs 26 are at the proper position to receive support rods 22. Also, the plate member 28 need only be of a lateral extent in a parallel direction to the folds 14 to receive the number of rods 22 necessary to support the blanket B on the furnace wall being insulated. The plate member 28, if desired, may also, however, extend completely across the lateral extent of block B in a parallel direction to the folds 14.

If desired, portions of the suspension tabs 26 can be removed at areas not proximate to the openings 24, leaving a plurality of individual suspension tabs located in pairs at various positions across the lateral extent of the channel member C in the direction of folds 14, with each such suspension tab pair receiving one of the support rods 22.

The modules M of the present invention are formed by folding the blanket B into the desired configuration, such as the one shown in the drawings. Channel members C are then mounted with the outer surface portion 20 so that the suspension tabs 26 extend between adjacent outer folds 14 at the requisite locations within the blanket B. A guide plate or other suitable positioning structure is then brought into proximity with the outermost side portion 16 of the blanket B and the support rods 22 are forced through the side portions 16 of the blanket B and through the openings formed in the suspension tabs of the particular suspension arm being used. If desired, a needle or other piercing device may be mounted ahead of the support rod 22 to facilitate passage of such rod 22 through the blanket B. Once the support rods 22 are properly positioned within the blanket B, the modules of the present invention may be wrapped with a suitable wrapping material to maintain them under compression prior to installation. The modules of the present invention are then mounted to inner surfaces of the equipment being insulated by stud welding or other suitable techniques.

With the channel member C of the present invention mounted extending parallel with the directions of the folds 14 of the blanket B and, if desired, covering less than any one complete surface dimension of the surface 20 of the blanket B, several advantages have been found. The support rods 22 can be bent to curved shapes (FIGS. 2 and 3) either during fabrication of the modules M, or as needed at an installation site, to conform to a curved or non-planar inner wall in the equipment being insulated. The modules M can, of course, be installed on planar or flat surfaces by keeping the rods 22 straight and unbent. Further, substantially less materials are required to fabricate supporting and attachment structure of the present invention than the prior art, while affording the requisite strength to support the modules M when installed.

With the modules of the present invention having the support rods 22 penetrating the side portions 16 of the blanket B in the vicinity of the outer folds 14, preferably substantially at the base of the folds 14, applicants have found that the blankets B being penetrated will hold significantly longer and at significantly greater weight loads against tearing than blankets of the edge-grain type. With the present invention, the upper fold 14 provides a compressed mass of fiber blanket material above rod 22 so that the fibers exhibit greater strength against tearing. Thus, applicants have found that the modules of the present invention exhibit increased strength against tearing forces which might tend to cause the blanket B to fall from or be torn from the wall of the furnace in use.

Further, only the folds of the blanket B between the suspension members restrict the folds of the blanket moving along the support rod 22. The compression in unrestricted folds of the blanket B is available for use in forming a tight joint with adjacent modules, since the unrestricted folds may slide along the rods 22. It is to be noted that the direction that the support rods 22 may be bent to various shapes so that the rods 22 pass through the adjacent side portions of blanket B in a manner required for the specific furnace location being insulated. For examples in FIGS. 4A, 4B, 4C and 4D, four alternative arrangements of support rods 22 in a blanket B of the present invention are shown for insulating a plane surface adjacent a tubular member 32 in a furnace. The blanket B in each situation shown is formed into folds in the manner of FIG. 1, but the block is formed in various shapes other than a parallelipiped because of installation requirements. In FIG. 4A, rods 22 extend radially with respect to the center of tube 32 in the blanket B and thus diverge from each other through the side portions of the blanket B. Openings are formed in channel C accordingly. Further, in FIG. 4A the rods 22 are of different length, as they are in each of FIGS. 4B, 4C and 4D. In each of FIGS. 4B and 4D, the rods 22 extend along parallel lines with respect to each other through the side portions of the blanket B. In FIG. 4C, the rods 22 are bent to extend through the folds in the blanket B in an arcuate fashion conforming to the tubular member 32.

The foregoing disclosure and description of the invention are illustrative and explanatory thereof and various changes in the size, shape and materials as well as in the details of the preferred embodiment may be made without departing from the spirit of the invention.

We claim:

1. An insulating module adapted for mounting adjacent an arcuate surface in a furnace or the like, said module comprising (a) a block of refractory ceramic fiber having an inner surface exposed to the high temperature environment of said furnace, an outer surface to be mounted adjacent an inner surface of the furnace; and a plurality of side surfaces extending between said inner and outer surfaces;

(b) suspension means extending over some portion of said outer surface of said block and having suspension arm means extending into said block, said suspension arm means having at least one aperture therein;

(c) support means mounted within said block and extending through the at least one aperture in said suspension arm means;

(d) at least one of the above named block surfaces being arcuate, the curvature thereof generally conforming to that of the arcuate surface adjacent to which it is to be mounted.

2. The insulating module of claim 1 wherein said block comprises a sinusoidally folded blanket of refractory ceramic fiber defining inner folds adjacent the inner surface and outer folds adjacent the outer surface.

3. The insulating module of claim 2 wherein said support means comprises at least one support rod extending through adjacent folds of said blanket in proximity to the outer folds.

4. The insulating module of claim 3 wherein said suspension arm means comprises at least two suspension tabs receiving said at least one support rod through aligned apertures therein.

5. The insulating module of claim 1 wherein both the inner and outer surfaces of said module are arcuate and the arcuate surface within the furnace is a wall of said furnace.

6. The insulating module of claim 1 wherein said at least one arcuate surface is one of said plurality of side surfaces.

7. The insulating module of claim 6 wherein at least two of said plurality of side surfaces are arcuate, the curvature of the shortest such side generally conforming to the curvature of said arcuate furnace surface.

8. The insulating module of claim 1 wherein said support means extends in a direction which is generally parallel to said arcuate block surface.

9. The insulating module of claim 1 wherein said suspension arm means comprise at least two suspension tabs extending into the fiber block.

10. The insulating module of claim 9 wherein a plurality of support rods are mounted in said fiber block and extend through sets of aligned apertures in said suspension tabs.

11. The insulating module of claim 10 wherein said plurality of rods have varying lengths.

12. The insulating module of claim 11 wherein said varying length support rods extend parallel to one another.

13. The insulating module of claim 12 wherein said parallel suport rods are curved.

14. The insulating module of claim 11 wherein said varying length support rods diverge from one another within the fiber block.

15. The insulating module of claim 1 wherein said arcuate furnace surface comprises a pipe or the like within the furnace and said module covers approximately ¼ of said pipe.

* * * * *